US006662734B2

(12) United States Patent
Chang

(10) Patent No.: US 6,662,734 B2
(45) Date of Patent: Dec. 16, 2003

(54) CONNECTION DEVICE FOR CONNECTING TABLE TOPS

(76) Inventor: Chien-Kuo Chang, Fl. 10-2, No. 447, Sec. 3, Wen-Hsin Rd., Taichung (TW)

( * ) Notice: Subject to any disclaimer, the term of this patent is extended or adjusted under 35 U.S.C. 154(b) by 17 days.

(21) Appl. No.: 09/972,975

(22) Filed: Oct. 10, 2001

(65) Prior Publication Data

US 2003/0066464 A1 Apr. 10, 2003

(51) Int. Cl.[7] ..... A47B 11/00
(52) U.S. Cl. ..... 108/103; 108/94; 108/158.11
(58) Field of Search ..... 108/94, 103, 104, 108/139, 64, 65; 16/365, 265

(56) References Cited

U.S. PATENT DOCUMENTS 3,920,276 A * 11/1975 Sparrow ..... 297/142
5,035,186 A * 7/1991 Uredat et al. ..... 108/159
5,704,298 A * 1/1998 Corpuz. et al. ..... 108/50.01
5,943,966 A * 8/1999 Machado et al. ..... 108/64
6,062,149 A * 5/2000 Duvivier et al. ..... 108/158.11
6,161,487 A * 12/2000 Chang ..... 108/50.01
6,497,184 B1 * 12/2002 Whitesitt ..... 108/64

* cited by examiner

*Primary Examiner*—Lanna Mai
*Assistant Examiner*—Jerry A. Anderson
(74) *Attorney, Agent, or Firm*—Rosenberg, Klein & Lee

(57) ABSTRACT

A connection device for tables includes a shaft on which a first part and a second part are respectively mounted thereon. The two parts are pivotally connected with each other and have their own connection shafts. Each of the connection shafts is connected to a table top so that the two table tops are pivotable about the shaft as desired.

1 Claim, 4 Drawing Sheets

CONNECTION DEVICE FOR CONNECTING TABLE TOPS

FIELD OF THE INVENTION

The present invention relates to a connection device that includes rings with different shafts, each shaft is connected to a table top so that these table tops can be positioned at different positions.

BACKGROUND OF THE INVENTION

A conventional office table generally includes a table top with four legs supported on a bottom of the table top. The top has a fixed area and is located at a fixed level that cannot changed so that a short or a tall user may not be satisfied. Besides, there are many office appliances are needed to be put on the table top for convenience of access. One table top will not be large enough to allow many appliances to be put thereon. U.S. Pat. No. 6,161,487 discloses an office table that includes connection parts so as to let the tops with different positions to meet different needs of the users. However, in order to put the tops at desired levels, several angled connection rods are used and which make the assembly job to be complicated.

SUMMARY OF THE INVENTION

In accordance with one aspect of the present invention, there is provided a connection device for tables and the device comprises a shaft having an insertion on which a first part and a second part are mounted. The first part includes a first connection shaft and a first plate is connected to an end of the first connection shaft. Two first rings are connected to the first plate and mounted to the insertion. The second part includes a second connection shaft and a second plate connected to an end of the second connection shaft. A second ring is connected to the second plate and inserted between the two first rings. Two table tops are respectively connected to the first and the second connection shaft.

The primary object of the present invention is to provide a connection device that is connected to at least two table tops so that these table tops can be swung about a shaft of the table or can be positioned at desired positions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
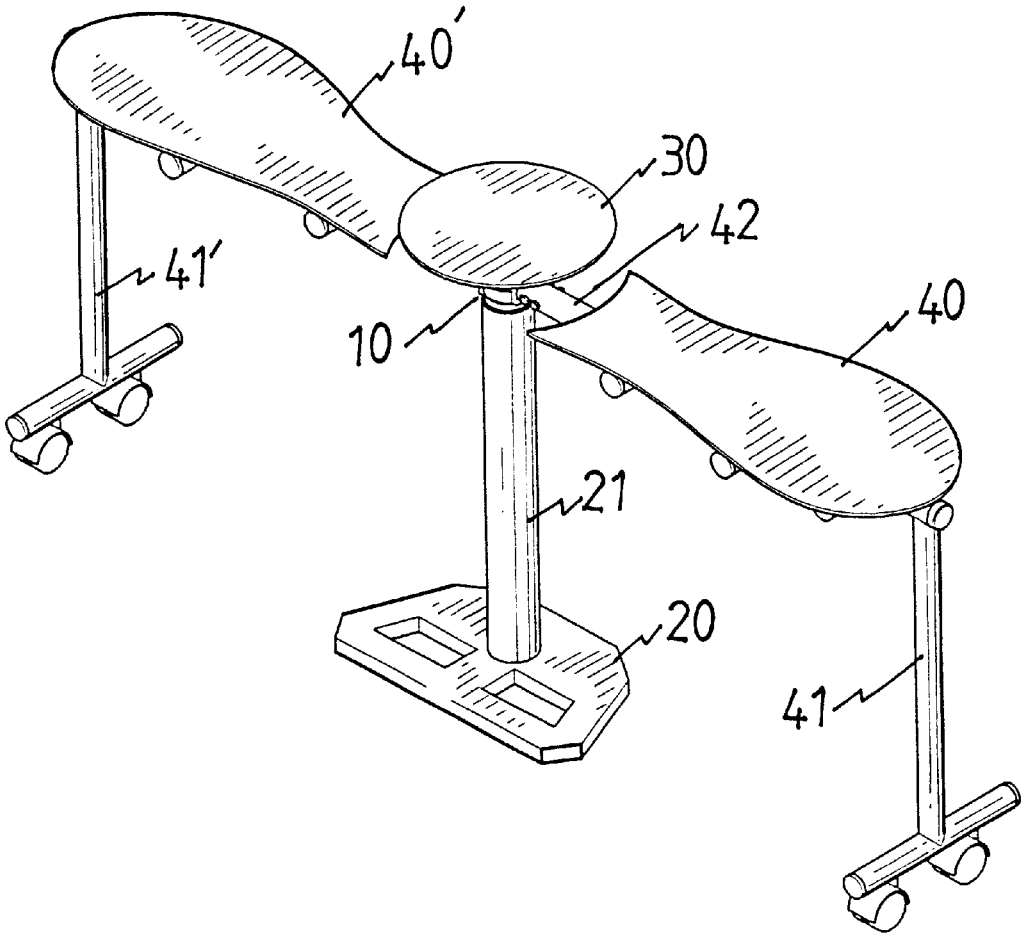
FIG. 1 is a perspective view to show a table assembly employing a connection device of the present invention.
Figure 2:
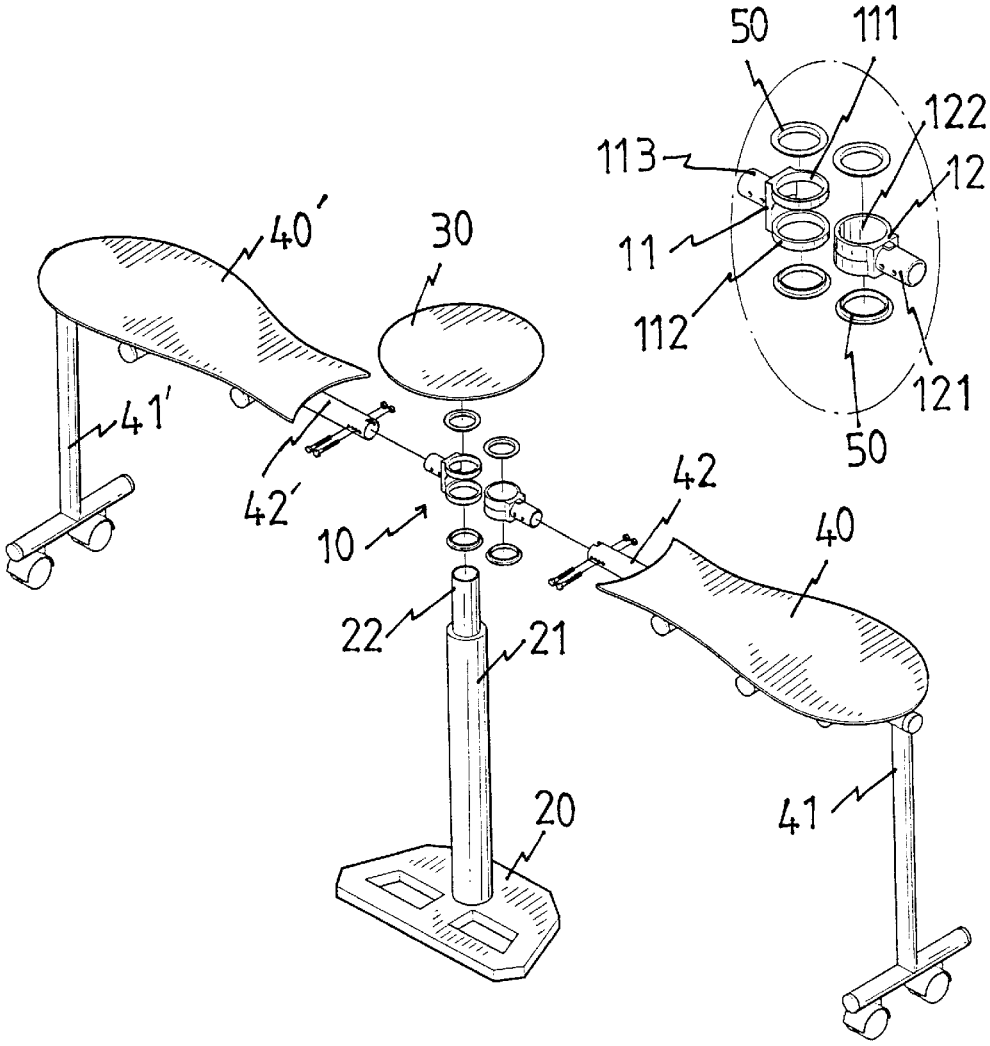
FIG. 2 is an exploded view to show the connection device of the present invention.
Figure 3:
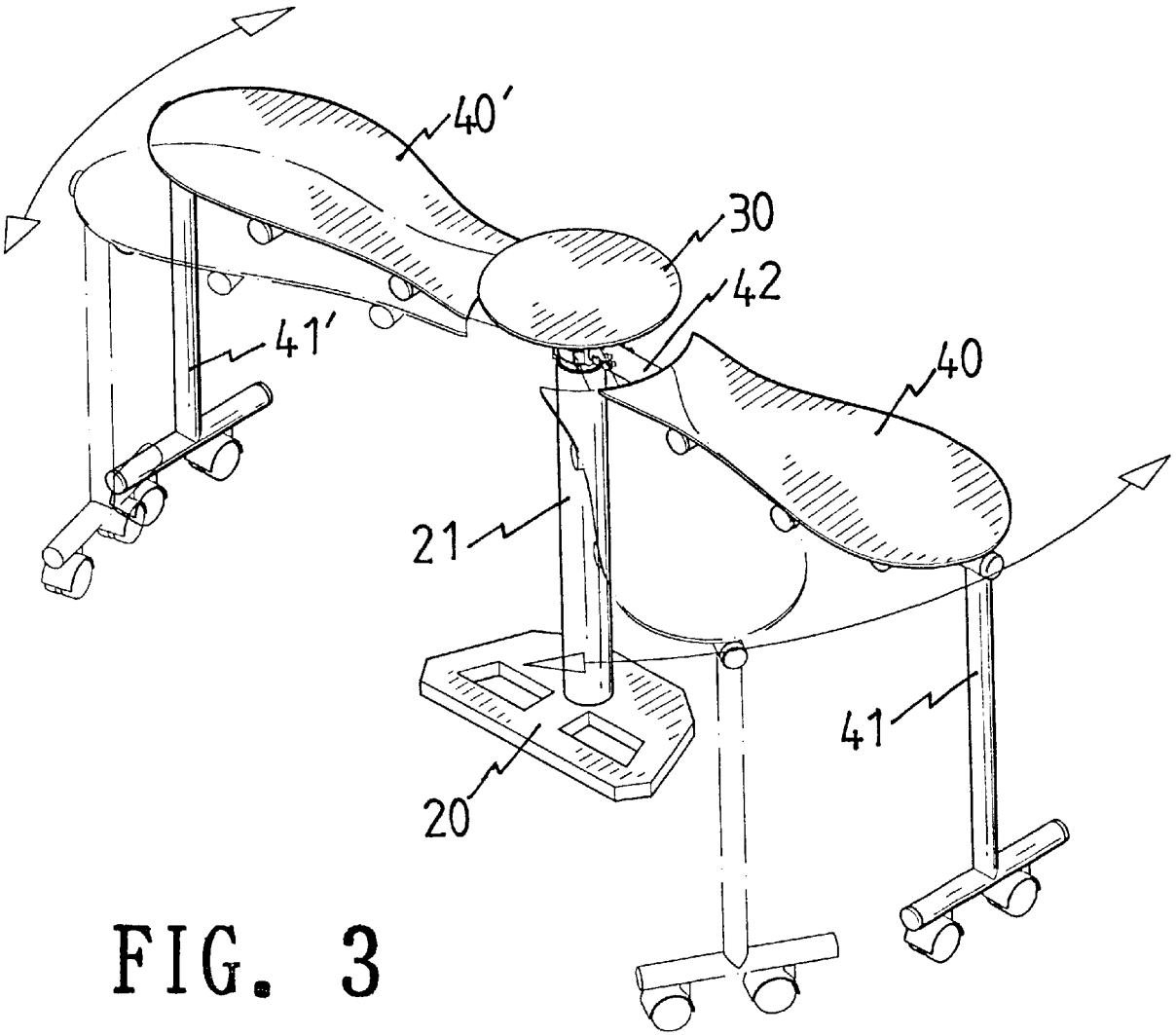
FIG. 3 is a perspective view to show the table tops of the table assembly of the present invention can be swung about the shaft.

Referring to FIGS. 1 and 2, the connection device 10 for tables of the present invention comprises a shaft 21 which has an insertion 22 on a top end thereof and a base 20 on a lower end thereof so that the shaft 21 can be put on the surface by the base 20. A first part is mounted to the insertion 22 and includes a first connection shaft 113 and a first plate 11 which is connected to an end of the first connection shaft 113. Two first rings 111, 112 are connected to the first plate 11 and mounted to the insertion 22.

A second part is mounted to the insertion 22 and includes a second connection shaft 121 and a second plate 12 which is connected to an end of the second connection shaft 121. A second ring 122 is connected to the second plate 12 and inserted between the two first rings 111, 112. The second ring 122 is also mounted to the insertion 22. Two washers 50 are located between the first rings 111, 112 and the second ring 122, and the other two washers 50 are located on the two first rings 111, 112. A cover 30 is mounted on the insertion 22 and enclose the connection device 10.

A first table top 40' has an extension tube 42' which receives the first connection shaft 113. A second table top 40 has an extension tube 42 which receives the second connection shaft 121. Each of the first table top 40' and the second table top 40 has a leg 41 which is connected to a dual-wheel caster.

Figure 4:
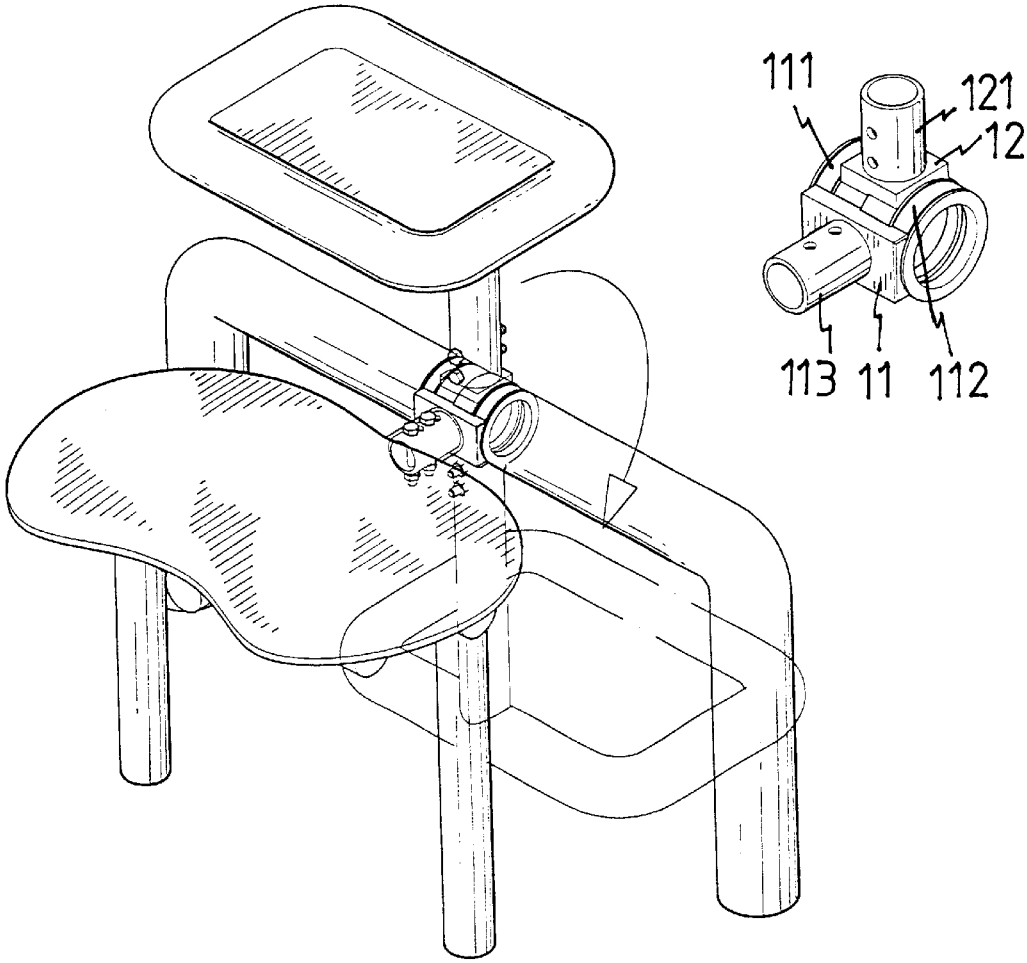
FIG. 4 shows the connection device of the present invention is cooperated another type of an office table.

Referring to FIG. 4, the first part and the second part can also be connected with each other at an right angle. In other words, the second connection shaft 121 can be pivoted at a right angle relative to the first connection shaft 113 so that the two respective table top can be pivoted relative to each other to two different level positions.

While we have shown and described the embodiment in accordance with the present invention, it should be clear to those skilled in the art that further embodiments may be made without departing from the scope of the present invention.

What is claimed is:

1. A connection device for tables, comprising:

a support shaft having an insertion; providing support on said tables a first part including a first connection shaft and a first plate connected to an end of said first connection shaft, two first rings connected to said first plate and mounted to said insertion;

a second part including a second connection shaft and a second plate connected to an end of said second connection shaft, a second ring connected to said second plate and connected to said insertion between said two first rings, and a first table top having an extension tube in which said first connection shaft is inserted and a second table top having an extension tube in which said second connection shaft is inserted.

* * * * *